United States Patent [19]

Dieringer

[11] Patent Number: 4,777,885

[45] Date of Patent: Oct. 18, 1988

[54] SPIKE DRIVING MACHINE INCLUDING LOCKING STRUT FOR SPIKE DRIVER GUN

[75] Inventor: Andrew M. Dieringer, Waterford, Wis.

[73] Assignee: Oak Industries, Inc., Rancho Bernardo, Calif.

[21] Appl. No.: 6,863

[22] Filed: Jan. 27, 1987

[51] Int. Cl.[4] ..... E01B 29/26

[52] U.S. Cl. ..... 104/17.1; 104/2

[58] Field of Search ..... 104/17.1, 2, 7 R, 7 B, 104/9, 12

[56] References Cited

U.S. PATENT DOCUMENTS

| | | | |
|---|---|---|---|
| 3,405,649 | 10/1968 | Foxx et al. | 104/17 |
| 3,426,698 | 2/1969 | Foxx et al. | 104/17 |
| 3,552,320 | 1/1971 | Traupmann | 104/17.1 |
| 3,610,158 | 10/1971 | Eidemanis | 104/17 |
| 3,717,101 | 2/1973 | Katcha et al. | 104/17 |
| 4,273,052 | 6/1981 | Woolner | 104/17.1 |
| 4,579,061 | 1/1986 | Dieringer | 104/17 |

FOREIGN PATENT DOCUMENTS 2812140 10/1978 Fed. Rep. of Germany ..... 104/19.1

*Primary Examiner*—Sherman D. Basinger
*Assistant Examiner*—Clifford T. Bartz
*Attorney, Agent, or Firm*—Kinzer, Plyer, Dorn, McEachran & Jambor

[57] ABSTRACT

In a rail spike driving machine having a frame, wheels and a spike driver gun slidable in parallel relationship to the rail, and control means for limiting that sliding action, an apparatus for releasably locking the position of said gun above a particular tie comprising a telescoping tube with an inner member and a hollow outer member, the inner member inserted at one end into the outer member and at the other end to the spike driver gun, the outer member receiving the inner member at one end and slidably secured to the frame at the other end to control the perpendicular action of the spike driver gun in relation to the rail, and a releasable brake assembly mounted on the outer member so as to exert a locking force on the inner member and prevent lateral movement of the spiker gun.

18 Claims, 3 Drawing Sheets

SPIKE DRIVING MACHINE INCLUDING LOCKING STRUT FOR SPIKE DRIVER GUN

BACKGROUND OF THE INVENTION

The present invention is related to machines used in the repair of railroad tracks, and more specifically to machines which drive spikes into railroad ties. An apparatus is provided for fixing the position of a spike driver gun over a desired location for spike placement.

Conventional spike driving machines comprise a motorized, wheeled frame to which is mounted at least one, and preferably two or four hydraulically powered spiker guns, one gun for each side of a rail. With four guns, both rails may be repaired simultaneously. Spiker guns basically comprise a hydraulic ram with a flat-ended shaft as the contact point. Problems occur when the flat end of the shaft contacts the rounded head of a spike.

Often, improper spike positioning, or discontinuities in spike shape or tie composition cause the ram to be deflected off of the spike head, most often in a direction perpendicular to the rail. This deflection results in bent spikes, the removal of which is quite time consuming. Further, the spiking operation must progress at a fairly rapid rate due to the large number of ties per mile (on the order of 3,000) and the generally repetitive nature of the work.

One previous attempt to solve this problem involved the use of a turn buckle to connect the spiker gun to the frame and ensure gun stability during the spike driving process. Unfortunately, this method required excessive manual adjustments to properly position the gun for each spike placement. Another attempted solution involved the use of a rigid gusset extending from the frame to the spiker gun to provide lateral support. This proved to be unsatisfactory due to the lack of adjustability.

A third alternative involved the mounting of a hydraulic strut between the frame and the spiker gun. However, the hydraulic cylinder was unable to maintain constant locking pressure due to fluid seepage.

Thus, there remains an outstanding need for a means of adjustably locking the position of a spiker gun to prevent movement perpendicular to the rail during the spike driving operation, while still permitting the freedom of movement necessary to position the gun over spike holes in various locations.

It is therefore an object of the present invention to provide a spiker gun locking strut which is capable of fixing the position of the gun over the spike, while having the ability to adjust the gun's position over different spike holes and in response to discontinuities in track construction.

SUMMARY OF THE INVENTION

In a railroad spike driving machine having a frame, wheels and a spike driver gun mounted on the frame to slide in both parallel and perpendicular relationship to the rail, means are provided to releasably lock the position of the gun above the railroad tie to permit accurate placement of spikes.

More specifically, a locking strut is provided, comprising an inner member secured at one end to the spiker gun and at the other in telescoping slidable fashion to the interior of a hollow outer member. The hollow outer member is secured to the frame in slidable fashion so that the locking strut may travel freely with the spiker gun in parallel orientation to the rail.

A locking device is provided to automatically lock the inner member to the outer member, thus fixing the position of the gun on a perpendicular axis to the rail above a particular tie. The locking device preferably consists of a releasable brake caliper half mounted to the outer member so that it exerts locking force upon the inner member. Control means are provided to allow the machine operator to automatically lock and release the brake as needed.

Thus, the present locking strut prevents movement of the spike driver gun in a perpendicular direction to the rail. Parallel movement is satisfactorily controlled by existing hydraulic means on the frame and a clamping device which holds the machine to the rail while spikes are being driven.

BRIEF DESCRIPTION OF THE DRAWINGS

The benefits and advantages of the present invention will become more apparent upon an inspection of the drawings, wherein.

DESCRIPTION OF THE PREFERRED EMBODIMENT

Figure 1:
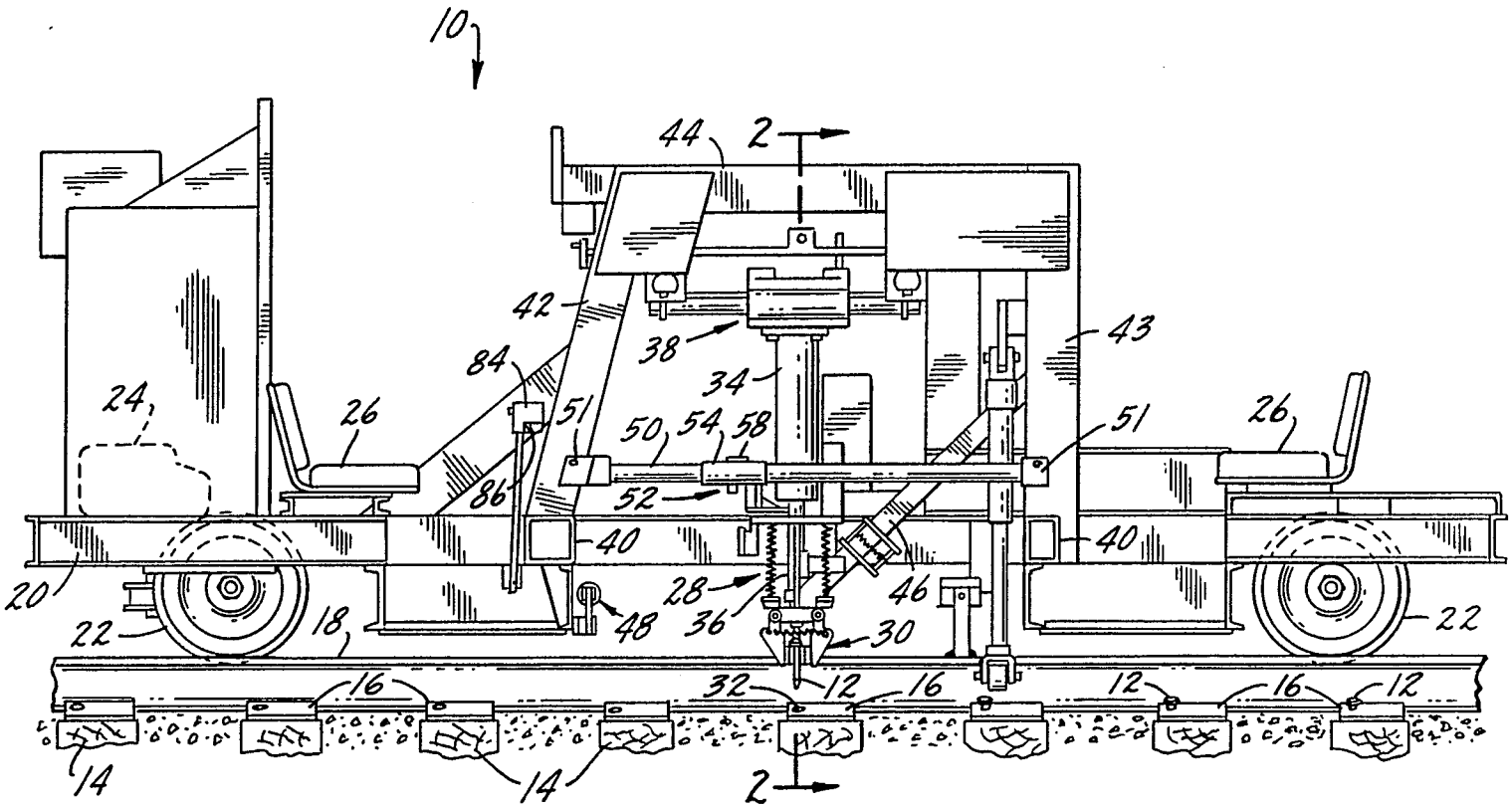
FIG. 1 is a side elevation of a spike driving machine embodying the present invention.
Figure 2:
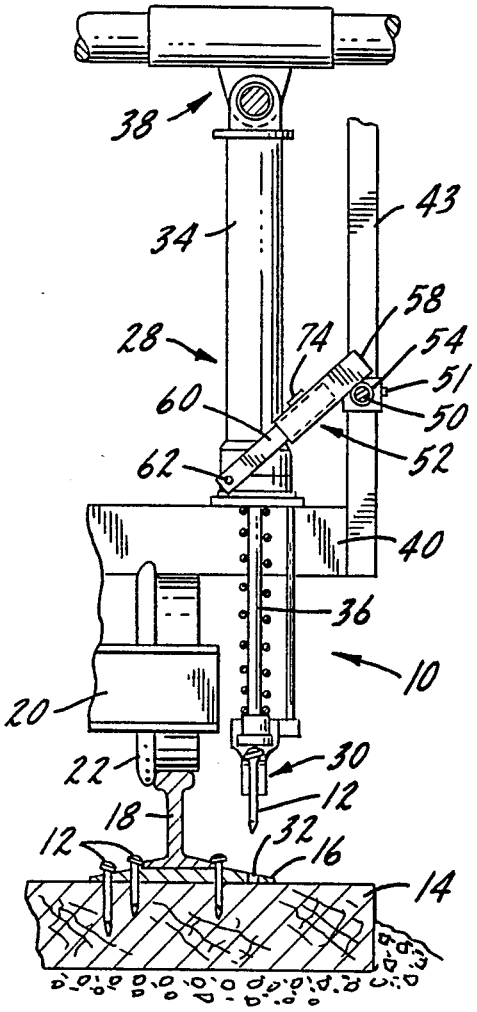
FIG. 2 is an enlarged partial section of the present spike driver machine taken along line 2—2 of FIG. 1 showing the present locking strut.
Figure 3:
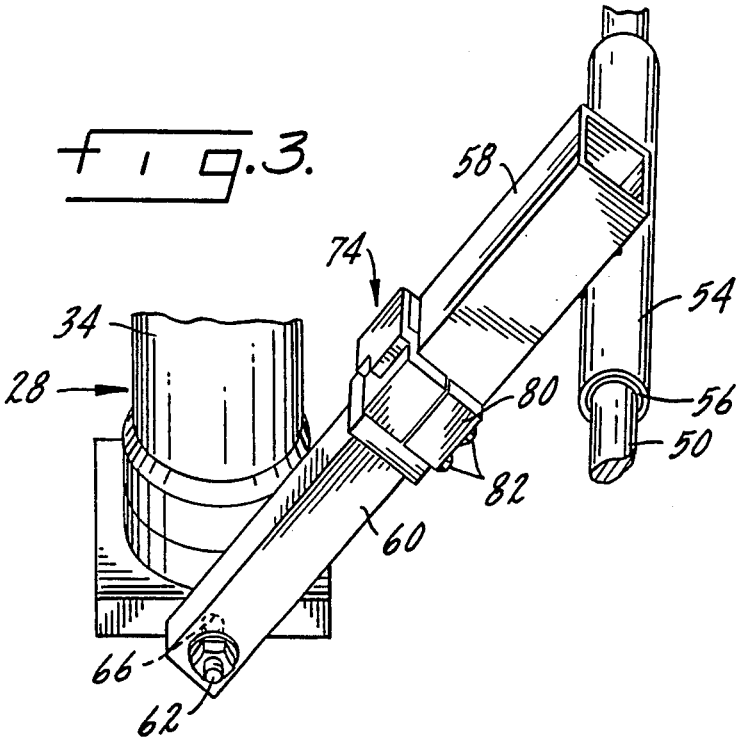
FIG. 3 is a perspective elevation of the locking strut of the present invention.
Figure 4:
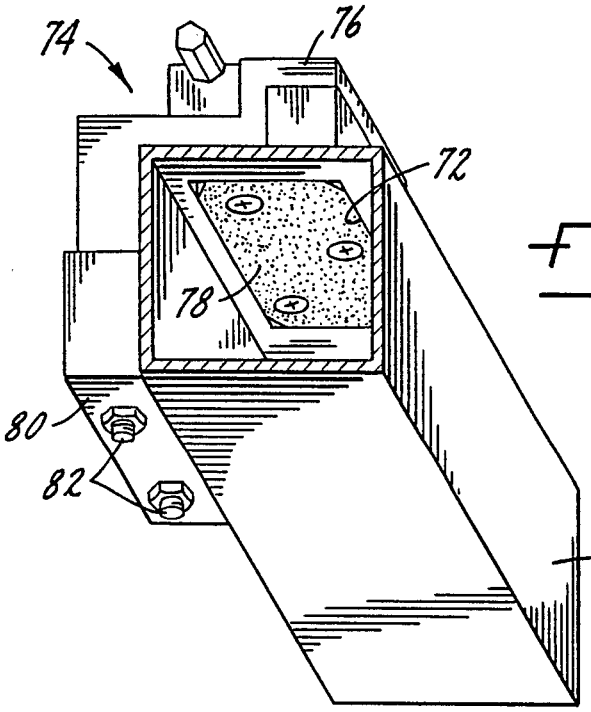
FIG. 4 is a perspective elevation of the outer member shown in FIG. 3 wherein the brake assembly is revealed in detail.

Referring now to the drawings, wherein like reference numerals denote like characteristics, FIGS. 1 and 2 depict a spike driving machine 10 embodying the present invention and adapted to drive spikes 12 through tie plates 16 into railroad ties 14 to secure tie plates 16 and rails 18 to the ties 14. The machine 10 includes a frame 20 supported on wheels 22 such that the frame 20 can be driven along the rails 18 of a railroad track. The frame 20 supports a conventional internal combustion engine 24 for driving the machine, and a pair of operator's seats 26. The machine 10 also includes means for driving spikes 12 into railroad ties 14.

The spike driving means or spiker gun 28 is conventional and is not shown on the drawings in great detail. Generally, the spiker gun 28 includes a spike feeding means, such as tray 46, through which the spikes are fed via gravity to a spike gripping assembly 30. The spike gripping assembly 30 is adapted to hold a spike until it can be properly positioned over a hole 32 in the tie plate 16, and to provide support until the spike can be driven downwardly through the hole 32 into the tie 14.

The means for driving the spike into the tie is provided by a hydraulic cylinder 34 and a downwardly extending piston 36 adapted to engage the head of the spike 12 and force it into the tie. A double carriage block support assembly 38 is also provided for suspending the cylinder 34 and the gripping assembly 30 from frame 20. Carriage block assembly 38 affords gun 28 the capability of parallel and perpendicular movement relative to rail 18.

The frame 20 also includes a transverse frame member 40 extending perpendicularly to the direction of movement of the machine, one end of the transverse frame member 40 being positioned over one of the rails 18 and adjacent the spike driving means 28, and the other end of the transverse frame member 40 positioned over the other of the rails 18. Although The transverse frame member 40 could have other constructions, in the illustrated embodiment it is comprised of a beam or channel depending from the frame 20 and having one end welded to one side of the frame 20 and an opposite end welded to an opposite side of the frame 20.

Frame 20 is also provided with a pair of angled vertical supports 42, a pair of perpendicular supports 43, and roof supports 44. One set of supports 42 and 43 are found on each side of the frame 20. Supports 42, 43, 44 are joined together by welding or other suitable fastening means to form a cage for the support of the carriage assembly 38 for each spiker gun 28.

Means are also provided for clamping the machine 10 to the rails 18 when the machine drives spikes 12 into the ties 14, the clamping means including a pair of clamp members 48 pivotally supported by the opposite ends of the transverse frame member 40. These clamping members are described in greater detail in U.S. Pat. No. 4,579,061 to Dieringer.

A cylindrical shaft 50 is securely mounted to frame 20 to span the area between supports 42 and 43, and to serve as a sliding axis for the locking strut assembly 52. Shaft 50 is bolted at each end to mounting plates 51, each of which is welded to respective supports 42, 43. Shaft 50 should be at least as long as, and parallel to support assembly 38 to enable locking strut assembly 52 to slide in unison with spiker gun 28.

This sliding action is achieved by the use of a sleeve 54 designed to circumscribe, slide upon and pivot around shaft 50. The interior of sleeve 54 is fitted with a low friction bushing 56 to facilitate the sliding action. A bushing 56 is preferably made of low friction polymeric materials and is pressure fit within sleeve 54. If sleeve 54 is too short, it will bind upon shaft 50 as it slides with gun 28. Thus, sleeve 54 should be of sufficient length so as to not bind on shaft 50.

An outer tube 58 having two ends is fixed at one end in perpendicular relationship to sleeve 54. Tube 58 is hollow and may be of various cross sectional shapes; however, a square shape is preferred. Whatever shape is selected for tube 58, it must be adapted to slidingly receive inner member 60 in telescoping fashion.

Inner member 60, either of solid or hollow construction, is inserted into tube 58 at one end and is secured to spiker gun 28 at the other. The specific means of securing inner member 60 to spike driver gun 28 may vary, but should provide some pivoting capability for inner member 60 about spiker gun 28. In the preferred embodiment, a stub shaft 62 is fixed to the exterior of cylinder 34 and is provided with a threaded end.

Inner member 60 is provided with an aperture 66 which will accept stub shaft 62. Threaded fastener means such as a lock nut and washer secure inner member 60 to spiker gun 28.

Outer tube 58 is provided with an aperture 72 in one side which will accept a braking means 74. Braking means 74 is provided to lock the position of inner member 60 in relation to outer tube 58, and in so doing, prevent any movement of spiker gun 28 perpendicular to the rail 18 during the spike driving operation. Although braking means 74 may comprise any conventional means of releasably securing inner member 60 in relation to outer tube 58, in the preferred embodiment, braking means 74 is comprised of an automotive-style hydraulic disc brake caliper half 76, which exerts pressure upon a brake pad or shoe 78 by means of a hydraulic cylinder controlled by an electric solenoid valve (not shown). In the preferred embodiment, caliper 76 is secured to the outer tube 58 by means of a mounting block 80 which is fastened to the side of outer tube 58 by conventional means such as welding. Caliper 76 is secured to mounting block 80 by mounting bolts 82.

In operation, the spiker machine 10, powered by engine 24, travels along the rails 18 under the control of an operator seated in one of seats 26. The operator controls the movement of a pair of spiker guns 28, each along a carriage assembly 38 on both sides of the rail by means of triggered joy stick 84. One pull of the trigger 86 brings the piston 36 partially down, with spike 12 in proximity to spike hole 32. The spiker guns 28 are then properly positioned over spike holes 32 in tie plate 16 by means of joy stick 84. The protruding spike 12 is used to "find" hole 32. The operator then pulls the trigger 86 a second time. This second trigger pull automatically activates braking means 74. Caliper 76 extends shoe 78 until it exerts sufficient pressure against inner member 60 to lock the position of inner member 60 relative to outer tube 58. At the same time that caliper 76 is activated, the spiker ram 36 then extends, driving a spike 12 into tie 14 through tie plate 16 without misaligning the spike. Once the spike has been driven, spiker ram 36 is retracted, and the braking means 74 is released, as is support assembly 38, allowing free movement of spiker gun 28 for proper positioning over the next adjacent tie plate hole 32.

Obviously, numerous modifications and variations of the disclosed embodiment will occur to those skilled in the art in view of this disclosure and the prior art. Accordingly, it is to be understood that these modifications and variations, and the equivalents thereof, may be practiced while remaining within the spirit and scope of the invention as set forth in the following claims.

What is claimed is:

1. In a railroad track repair machine for driving spikes or the like, including a frame, wheels adapted to engage the rails so that the frame may move along the track, a spike driving apparatus including a spike driving gun mounted to said frame so as to slide in parallel relation to said rails along a first sliding means, and means to control the sliding action of said gun; means to lock the position of said gun on said frame comprising:

second sliding means mounted to said frame on a horizontal plane and parallel to said rails;

a telescoping support assembly having two ends, and mounted at one end to said gun and at the other end to said second sliding means; and a releasable hydraulic locking brake mounted on said telescoping support assembly and designed to secure the telescoping section of said strut in a direction perpendicular to the sliding relationship of said gun on said frame.

2. The apparatus described in claim 1 wherein said second sliding means is a rigid shaft with a slidable sleeve circumscribing it.

3. The apparatus defined in claim 2 wherein said support strut is mounted to said rigid shaft by means of said sleeve which slidably engages said shaft.

4. The apparatus defined in claim 1 wherein said telescoping strut is comprised of an inner member and an outer tubular member, said inner member engaging said gun and said outer member engaging said second sliding means.

5. The apparatus defined in claim 4 wherein said locking brake is mounted to said outer tubular member and exerts locking force upon said inner member.

6. In a railroad track repair machine for driving spikes or the like, including a frame, wheels adapted to engage the rails so that the frame may move along the track, a spike driving gun mounted to said frame so as to slide in parallel relation to said rail along a first sliding means and means to control the sliding action of said gun; means to lock the position of said gun on said frame comprising:

a rigid shaft mounted to said frame on a horizontal plane and parallel to the rails;

a sleeve means constructed and arranged to slidably engage said shaft along a first direction, said sleeve means supporting an outer tube assembly oriented perpendicular to the rail;

means on said frame for slidably moving and releasably securing said gun above said rail in said first direction;

said outer tube assembly comprising a rigid square hollow tube and a brake means positioned in said tube;

a rigid square inner tube having two ends, one of said ends being constructed and arranged to be slidably inserted within said outer tube so that said inner tube may freely slide within said outer tube, and the other of said ends pivotably secured to said spike driver gun;

said outer tube assembly and said inner tube means providing gun adjustment in a second direction;

and braking means constructed and arranged to releasably lock said inner tube within said outer tube and secure the position of said gun over said tie in said second direction.

7. The apparatus defined in claim 5 wherein said telescoping strut is comprised in inner and outer square tubes.

8. The apparatus defined in claim 7 wherein said locking brake is a releasable automatic brake caliper half mounted to said outer member and having a shoe which lockingly engages said inner member.

9. In a rail spike driving machine having a frame, an apparatus for accurately positioning a railroad spike driving gun over a rail tie, comprising:

a rigid shaft mounted to said frame on a horizontal plane and parallel to the rails;

a sleeve means constructed and arranged to slidably engage said shaft along a first direction, said sleeve means supporting an outer tube assembly oriented perpendicular to the rail;

means on said frame for slidably moving and releasably securing said gun above said rail in said first direction;

said outer tube assembly comprising a rigid hollow tube and a brake means positioned in said tube;

a rigid inner tube means having two ends, one of said ends being constructed and arranged to be slidably inserted within said outer tube, and the other of said ends pivotably secured to said spike driver gun;

said outer tube assembly and said inner tube means providing gun adjustment in a second direction;

said brake means comprising a hydraulically operated brake shoe constructed and arranged to releasably lock said inner tube within said outer tube, and secure the position of said gun over said tie in said second direction.

10. The apparatus defined in claim 9 further including means to control said braking means.

11. The apparatus defined in claim 10 wherein said control means is electronically controlled hydraulic means.

12. The apparatus defined in claim 9 wherein said braking means comprises an automotive hydraulic caliper half with a shoe.

13. The apparatus defined in claim 12 wherein said shoe is constructed and arranged to releasably lockingly engage said inner tube.

14. The apparatus defined in claim 9 wherein said inner tube and said outer tube assembly are telescoping square channels having four faces.

15. The apparatus defined in claim 14 wherein said brake means comprises an hydraulic caliper half and a brake shoe, wherein said shoe is configured to engage a face of said inner channel.

16. The apparatus defined in claim 9 wherein said sleeve is provided with internal bearing means.

17. The apparatus defined in claim 16 wherein said internal bearing means is a bushing.

18. The apparatus defined in claim 9 wherein said outer tube assembly is fixed in perpendicular position to said sleeve.

* * * * *